US009274463B2

(12) United States Patent
Battat et al.

(10) Patent No.: US 9,274,463 B2
(45) Date of Patent: Mar. 1, 2016

(54) HEAT TRANSFER SYSTEM FOR A FUSER ASSEMBLY

(71) Applicant: Lexmark International, Inc., Lexington, KY (US)

(72) Inventors: David Battat, Huntsville, AL (US); Benjamin Karnik Johnson, Lexington, KY (US); Charles Scott McDavid, Frankfort, KY (US)

(73) Assignee: Lexmark International, Inc.KY (US)

( * ) Notice: Subject to any disclaimer, the term of this patent is extended or adjusted under 35 U.S.C. 154(b) by 0 days.

(21) Appl. No.: 14/024,980

(22) Filed: Sep. 12, 2013

(65) Prior Publication Data

US 2015/0063857 A1 Mar. 5, 2015

Related U.S. Application Data

(60) Provisional application No. 61/870,577, filed on Aug. 27, 2013.

(51) Int. Cl.
*G03G 15/20* (2006.01)
*G03G 21/20* (2006.01)

(52) U.S. Cl.
CPC ..... *G03G 15/2021* (2013.01); *G03G 15/2017* (2013.01); *G03G 21/206* (2013.01); *G03G 2215/2035* (2013.01)

(58) Field of Classification Search
CPC ..... G03G 15/2021; G03G 15/2017; G03G 21/206; G03G 2215/2035
USPC ..... 399/33, 67, 92, 94, 122, 331, 338, 400
See application file for complete search history.

(56) References Cited

U.S. PATENT DOCUMENTS

| | | | | |
|---|---|---|---|---|
| 4,050,803 | A | | 9/1977 | Mccarroll |
| 4,145,181 | A | | 3/1979 | Edwards et al. |
| 4,392,739 | A | | 7/1983 | Brown et al. |
| 4,869,707 | A | | 9/1989 | Zandt et al. |
| 5,212,528 | A | * | 5/1993 | Matsuda ..... 399/33 |
| 5,384,630 | A | | 1/1995 | Nakamura et al. |
| 5,534,984 | A | | 7/1996 | Inoue |
| 5,629,755 | A | | 5/1997 | Ohtsuka |

(Continued)

FOREIGN PATENT DOCUMENTS

| | | | | |
|---|---|---|---|---|
| JP | 01121883 A | * | 5/1989 | ..... G03G 15/20 |
| JP | 01266557 A | * | 10/1989 | ..... G03G 15/00 |
| JP | 06317994 A | | 11/1994 | |

OTHER PUBLICATIONS

International Search Report and Wirtten Opinion of the International Searching Authority for PCT application PCT/US2014/042323, Oct. 31, 2014.

(Continued)

*Primary Examiner* — Francis Gray

(57) ABSTRACT

A fuser assembly for an electrophotographic imaging device which removes excess heat from overheated portions of the fuser assembly and includes a heating member; a backup roll disposed proximate to the heating member so as to form a fuser nip therewith; and a heat exchange roll in contact with the backup roll such that rotation of the backup roll rotates the heat exchange roll, the heat exchange roll having an air passage for moving cooling air from one end to an opposite end of the heat exchange roll so as to provide cooling to the fuser assembly.

22 Claims, 5 Drawing Sheets

(56) References Cited

U.S. PATENT DOCUMENTS

| | | | | |
|---|---|---|---|---|
| 5,638,158 | A | 6/1997 | Sanpe et al. | |
| 6,157,806 | A | 12/2000 | Elbert et al. | |
| 6,253,046 | B1 | 6/2001 | Horrall et al. | |
| 6,345,169 | B1 | 2/2002 | Haneda et al. | |
| 7,349,660 | B2 * | 3/2008 | Domoto et al. | 399/328 |
| 7,398,028 | B2 * | 7/2008 | Nakagaki | 399/69 |
| 7,925,198 | B2 * | 4/2011 | Urano | 399/333 |
| 7,995,957 | B2 | 8/2011 | Sone et al. | |
| 8,180,269 | B2 | 5/2012 | Beach et al. | |
| 8,200,137 | B2 | 6/2012 | Foster et al. | |
| 8,238,770 | B2 * | 8/2012 | Shimizu | 399/33 |
| 2004/0120741 | A1 | 6/2004 | Kim et al. | |
| 2005/0025511 | A1 | 2/2005 | Watabe | |
| 2005/0089343 | A1 | 4/2005 | Mathers | |
| 2006/0291919 | A1 * | 12/2006 | Domoto et al. | 399/328 |
| 2010/0054828 | A1 * | 3/2010 | Urano | 399/333 |
| 2010/0329705 | A1 * | 12/2010 | Cao et al. | 399/33 |
| 2011/0222933 | A1 | 9/2011 | Maruyama et al. | |
| 2013/0058673 | A1 | 3/2013 | Kikkawa | |
| 2013/0251392 | A1 * | 9/2013 | Ueda et al. | 399/94 |
| 2014/0369725 | A1 * | 12/2014 | Bayerle et al. | 399/329 |
| 2014/0369729 | A1 | 12/2014 | Bayerle et al. | |
| 2014/0369730 | A1 | 12/2014 | Bayerle et al. | |

OTHER PUBLICATIONS

Notice of Allowance for U.S. Appl. No. 14/136,987, dated Aug. 20, 2015.

Notice of Allowance for U.S. Appl. No. 14/137,407, dated Sep. 21, 2015.

Notice of Allowance for U.S. Appl. No. 14/137,609, dated Jun. 24, 2015.

* cited by examiner

HEAT TRANSFER SYSTEM FOR A FUSER ASSEMBLY

CROSS REFERENCES TO RELATED APPLICATIONS

The present application is related to U.S. provisional application No. 61/834,869, filed Jun. 13, 2013, entitled, "Heat Transfer System for A Fuser Assembly," and is related to and claims priority from U.S. provisional application No. 61/870,577, filed Aug. 27, 2013, entitled, "Heat Transfer System for a Fuser Assembly," the contents of which are hereby incorporated by reference herein in their entirety.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Disclosure

The present disclosure relates generally to a fuser assembly for an electrophotographic imaging device and particularly to a fuser assembly having a heat transfer system which removes excess heat from a portion of the fuser assembly.

2. Description of the Related Art

In a belt fuser assembly for an electrophotographic imaging device, an endless belt surrounds a ceramic heating element. The belt is pushed against the heating element by a pressure roller to create the fusing nip. The heating element, typically a thick-film resistor on a ceramic slab, extends the full width of the printing process in order to suitably heat and fuse toner to the widest media sheets used with the imaging device. The fusing heat is controlled by measuring the temperature of the ceramic slab with a thermistor that is held in intimate contact with the ceramic and feeding the temperature information to a microprocessor-controlled power supply in the imaging device. The power supply applies power to the thick-film resistor when the temperature sensed by the thermistor drops below a first predetermined level, and interrupts power when the temperature exceeds a second predetermined level. In this way, the fuser assembly is maintained at temperature levels suitable for fusing toner to media sheets without overheating.

When printing on media sheets having widths that are less than the widest media width on which the imaging device can print, the media sheet removes heat from the fuser assembly in the portion of the fuser that contacts the media. Because the portion of the fuser assembly beyond the width of the media sheet does not lose any heat through the sheet, this second portion of the fuser assembly becomes hotter than the portion of the fuser assembly which contacts the media sheet. In order to prevent thermal damage to components of the fuser assembly, steps are taken to limit the overheating of the second portion of the fuser assembly. Typically, the inter-page gap between successive media sheets being printed is increased when media sheets less than the full width are used, thereby reducing the rate at which thermal energy is introduced through the fuser but at the expense of decreasing the process speed of the imaging device.

As imaging device speeds increase, the tolerable range of media width variation at full speed becomes smaller. In the case of imaging devices operating at 60 pages per minute (ppm) and above, a media width difference of 3 mm to 4 mm is seen to cause overheating in the small portion of the fuser assembly which does not contact the media sheet. For example, because letter paper and A4 paper differ in width by 6 mm, with A4 paper being narrower, an imaging device designed for printing on letter width media sheets and operating at 60 ppm or greater is seen to cause the portion of the fuser not contacting the media sheet to overheat if A4 paper is used, with the result that a letter width imaging device will necessarily slow down when printing on A4 media.

One approach to print on both letter and A4 width media at full process speeds using a letter width imaging device is to have two different fuser mechanisms—one fuser mechanism having a heater of the correct length for A4 media, and a second fuser mechanism having a heater for letter width media. However, problems occur if the fuser mechanism selected for a print job does not match the media sheet width. If the fuser mechanism associated with letter width printing is used for a print job using A4 media sheets, the fuser assembly may overheat as explained above. Conversely, if the fuser mechanism associated with A4 width printing is used for a print job using letter width media, the toner on the outermost 6 mm (for an edge-referenced imaging device) of the printed area is not sufficiently fused to the letter width media sheet.

Based upon the foregoing, a need exists for an improved fuser assembly for use with printing on narrower media sheets.

SUMMARY

Example embodiments of the present disclosure overcome shortcomings in existing imaging devices and satisfy a need for a fuser assembly that removes excess heat from a portion of the fuser assembly which does not contact narrower media sheets.

According to an example embodiment, there is disclosed a fuser assembly including a heating member; a backup roll disposed proximate to the heating member so as to form a fuser nip therewith, and a heat exchange roll in contact with one of the backup roll and the heating member such that rotation of the one of the backup roll and the heating member rotates the heat exchange roll, the heat exchange roll having an air passage for moving cooling air from one end to an opposite end of the heat exchange roll so as to provide cooling to the fuser assembly. The heat exchange roll transfers heat from a portion of the backup roll and heating member having higher temperatures, due to not contacting a media sheet during a fusing operation, to a portion thereof having a lower temperature from contacting the media sheet. In this way, overheating of the backup roll and/or heating member due to printing on narrower media sheets is substantially prevented.

In an example embodiment, the heat exchange roll includes an inlet configured to receive the cooling air from a fan adjacent to one end of the heat exchange roll and an exit at the opposite end of the heat exchange roll. The inlet is positioned proximate the end of the heat exchange roll in contact with a higher temperature section of the backup roll relative to a temperature of the section of the backup roll proximate the opposite end. An exhaust duct is provided adjacent to the opposite end of the heat exchange roll to provide an exit for the cooling air.

In an example embodiment, the heat exchange roll includes a hollow tube having a plurality of fins extending from an inner surface of the hollow tube towards a rotational axis of the heat exchange roll.

In another example embodiment, the heat exchange roll includes a cylinder having a plurality of spokes extending radially towards an outer shell having an outer surface in contact with the backup roll, the outer shell extending along the cylinder from one end to an opposite end thereof.

BRIEF DESCRIPTION OF THE DRAWINGS

The above-mentioned and other features and advantages of the disclosed example embodiments, and the manner of attaining them, will become more apparent and will be better understood by reference to the following description of the disclosed example embodiments in conjunction with the accompanying drawings, wherein.

DETAILED DESCRIPTION

Figure 1:
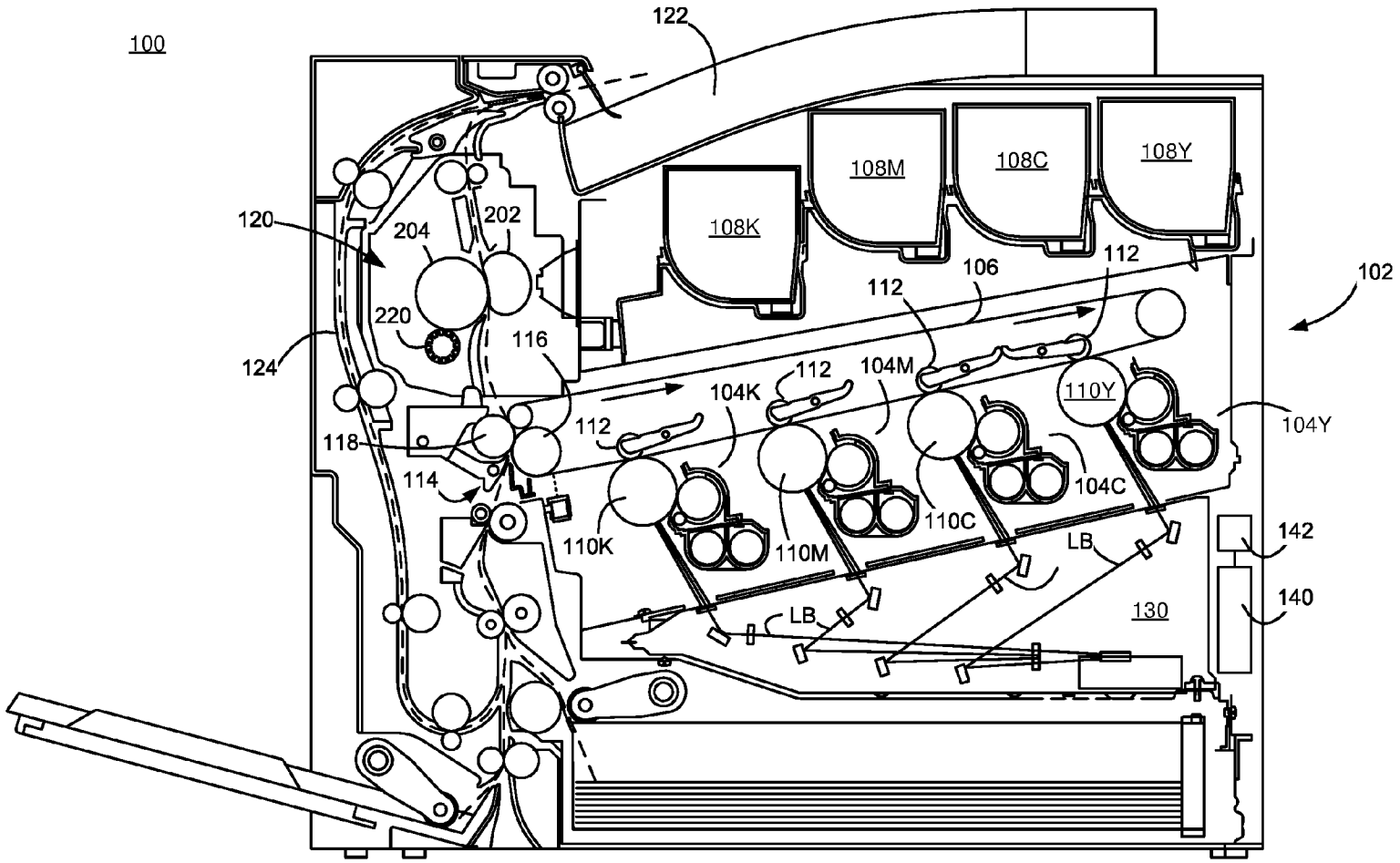
FIG. 1 is a side elevational view of an image forming apparatus according to an example embodiment.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and positionings. In addition, the terms "connected" and "coupled" and variations thereof are not restricted to physical or mechanical connections or couplings.

Spatially relative terms such as "top", "bottom", "front", "back" and "side", and the like, are used for ease of description to explain the positioning of one element relative to a second element. Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

FIG. 1 illustrates a color image forming device 100 according to an example embodiment. Image forming device 100 includes a first toner transfer area 102 having four developer units 104 that substantially extend from one end of image forming device 100 to an opposed end thereof. Developer units 104 are disposed along an intermediate transfer member (ITM) 106. Each developer unit 104 holds a different color toner. The developer units 104 may be aligned in order relative to the direction of the ITM 106 indicated by the arrows in FIG. 1, with the yellow developer unit 104Y being the most upstream, followed by cyan developer unit 104C, magenta developer unit 104M, and black developer unit 104K being the most downstream along ITM 106.

Each developer unit 104 is operably connected to a toner reservoir 108 for receiving toner for use in a printing operation. Each toner reservoir 108 is controlled to supply toner as needed to its corresponding developer unit 104. Each developer unit 104 is associated with a photoconductive member 110 that receives toner therefrom during toner development to form a toned image thereon. Each photoconductive member 110 is paired with a transfer member 112 for use in transferring toner to ITM 106 at first transfer area 102.

During color image formation, the surface of each photoconductive member 110 is charged to a specified voltage, such as −800 volts, for example. At least one laser beam LB from a printhead or laser scanning unit (LSU) 130 is directed to the surface of each photoconductive member 110 and discharges those areas it contacts to form a latent image thereon. In one embodiment, areas on the photoconductive member 110 illuminated by the laser beam LB are discharged to approximately −100 volts. The developer unit 104 then transfers toner to photoconductive member 110 to form a toner image thereon. The toner is attracted to the areas of the surface of photoconductive member 110 that are discharged by the laser beam LB from LSU 130.

ITM 106 is disposed adjacent to each of developer unit 104. In this embodiment, ITM 106 is formed as an endless belt disposed about a drive roller and other rollers. During image forming operations, ITM 106 moves past photoconductive members 110 in a clockwise direction as viewed in FIG. 1. One or more of photoconductive members 110 applies its toner image in its respective color to ITM 106. For monocolor images, a toner image is applied from a single photoconductive member 110K. For multi-color images, toner images are applied from two or more photoconductive members 110. In one embodiment, a positive voltage field formed in part by transfer member 112 attracts the toner image from the associated photoconductive member 110 to the surface of moving ITM 106.

ITM 106 rotates and collects the one or more toner images from the one or more developer units 104 and then conveys the one or more toner images to a media sheet at a second transfer area 114. Second transfer area 114 includes a second transfer nip formed between at least one back-up roller 116 and a second transfer roller 118.

Fuser assembly 120 is disposed downstream of second transfer area 114 and receives media sheets with the unfused toner images superposed thereon. In general terms, fuser assembly 120 applies heat and pressure to the media sheets in order to fuse toner thereto. After leaving fuser assembly 120, a media sheet is either deposited into output media area 122 or enters duplex media path 124 for transport to second transfer area 114 for imaging on a second surface of the media sheet.

Image forming device 100 is depicted in FIG. 1 as a color laser printer in which toner is transferred to a media sheet in a two step operation. Alternatively, image forming device 100 may be a color laser printer in which toner is transferred to a media sheet in a single step process—from photoconductive members 110 directly to a media sheet. In another alternative embodiment, image forming device 100 may be a monochrome laser printer which utilizes only a single developer unit 104 and photoconductive member 110 for depositing black toner directly to media sheets. Further, image forming device 100 may be part of a multi-function product having, among other things, an image scanner for scanning printed sheets.

Image forming device 100 further includes a controller 140 and memory 142 communicatively coupled thereto. Though not shown in FIG. 1, controller 140 may be coupled to components and modules in image forming device 100 for controlling same. For instance, controller 140 may be coupled to toner reservoirs 108, developer units 104, photoconductive members 110, fuser assembly 120 and/or LSU 130 as well as to motors (not shown) for imparting motion thereto. It is understood that controller 140 may be implemented as any number of controllers and/or processors for suitably controlling image forming device 100 to perform, among other functions, printing operations.

Figure 2:
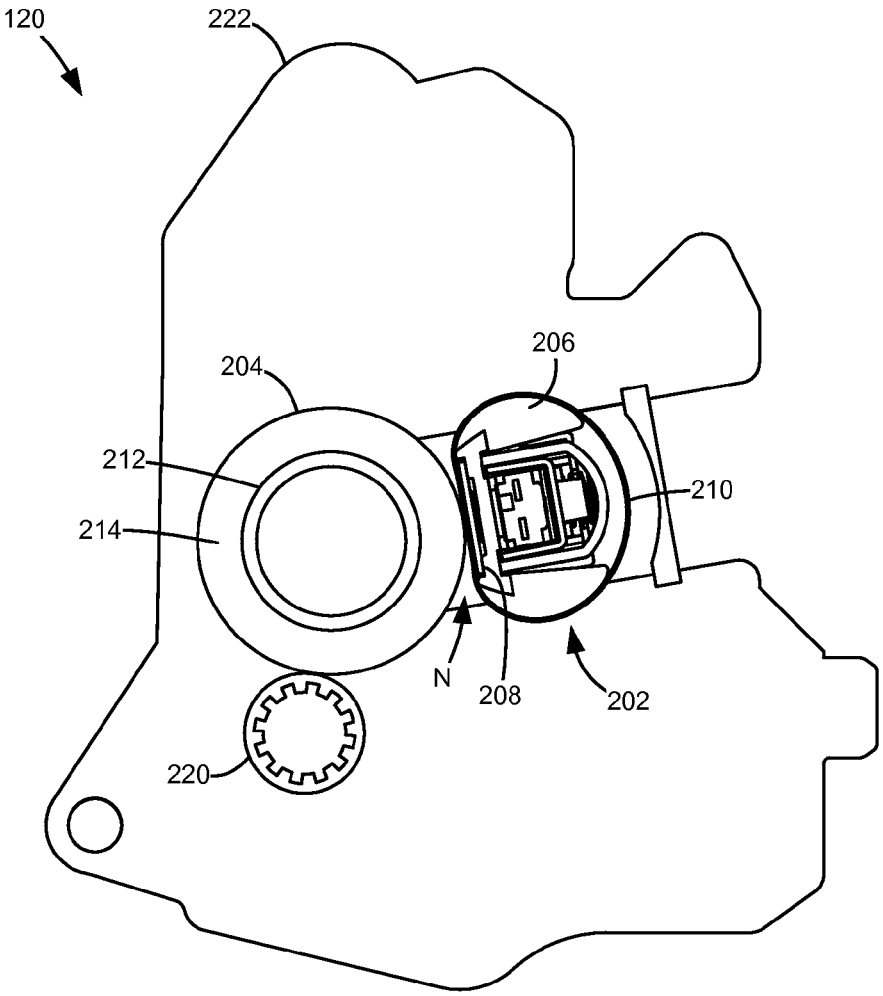
FIG. 2 is a side cross-sectional view of a fuser assembly of FIG. 1 according to an example embodiment.

With respect to FIG. 2, in accordance with an example embodiment, fuser assembly 120 may include a heating member 202 and a backup roll 204 cooperating with the heating member 202 to define a fuser nip N1 for conveying media sheets therein. The heating member 202 may include a housing 206, a heater element 208 supported on or at least partially within housing 206, and an endless flexible fuser belt 210 positioned about housing 206. Heater element 208 may be formed from a substrate of ceramic or like material to which one or more resistive traces is secured which generates heat when a current is passed through the resistive traces. Heater element 208 may further include at least one temperature sensor, such as a thermistor, coupled to the substrate for detecting a temperature of heater element 208. It is understood that heater element 208 alternatively may be implemented using other heat generating mechanisms.

Belt 210 is an endless belt that is disposed around housing 206 and heater element 208. Belt 210 may include a flexible thin film, and specifically includes a stainless steel tube; an elastomeric layer, such as a silicone rubber layer covering the stainless steel tube; and a release layer, such as a PFA (polyperfluoroalkoxy-tetrafluoroethylene) sleeve covering the elastomeric layer. The release layer of belt 210 is formed on the outer surface of the stainless steel tube so as to contact substrates 14 passing between the heating member 202 and backup roll 204.

Backup roll 204 may include a hollow core 212 covered with an elastomeric layer 214, such as silicone rubber, and a fluororesin outer layer (not shown), such as may be formed, for example, by a spray coated PFA layer, PFA-PTFE (polytetrafluoroethylene) blended layer, or a PFA sleeve. Backup roll 204 may have an outer diameter between about 20 mm and about 50 mm, and may be driven by a fuser drive train (not shown) to convey media sheets through the fuser assembly 120. Belt 210 contacts backup roll 204 such that belt 210 rotates about housing 206 and heater element 208 in response to backup roll 204 rotating. With belt 210 rotating about housing 206 and heater element 208, the inner surface of belt 210 contacts heater element 208 so as to heat fuser belt 210 to a temperature sufficient to perform a fusing operation for fusing toner to sheets of media.

Heating member 202 and backup roll 204 may be constructed from the elements and in the manner as disclosed in U.S. Pat. Nos. 7,235,761 and 8,175,482 the contents of which are incorporated by reference herein in their entirety. It is understood, though, that fuser assembly 120 may have a different construction and even utilize a different architecture from a fuser belt based architecture. For example, fuser assembly 120 may be a hot roll fuser, including a heated roll and a backup roll engaged therewith to form a fuser nip through which media sheets traverse.

Heating member 202 and backup roll 204 of fuser assembly 120 may be dimensioned to suitably fuse toner on sheets of media having a wide range of widths. As described above, when printing on media sheets having widths that are narrower than the widest sheet width on which image forming device 100 is capable of printing (hereinafter "narrower media sheet"), heat appearing on the portion of backup roll 204 and belt 210 which does not contact the narrower media sheet is not removed thereby, resulting in either such portion of backup roll 204 and belt 210 becoming overheated during a printing operation or requiring the process speed be substantially slowed. According to example embodiments, fuser assembly 120 may include a heat transfer system for removing excess heat from the portion of backup roll 204 which does not contact narrower media sheets.

Figure 3:
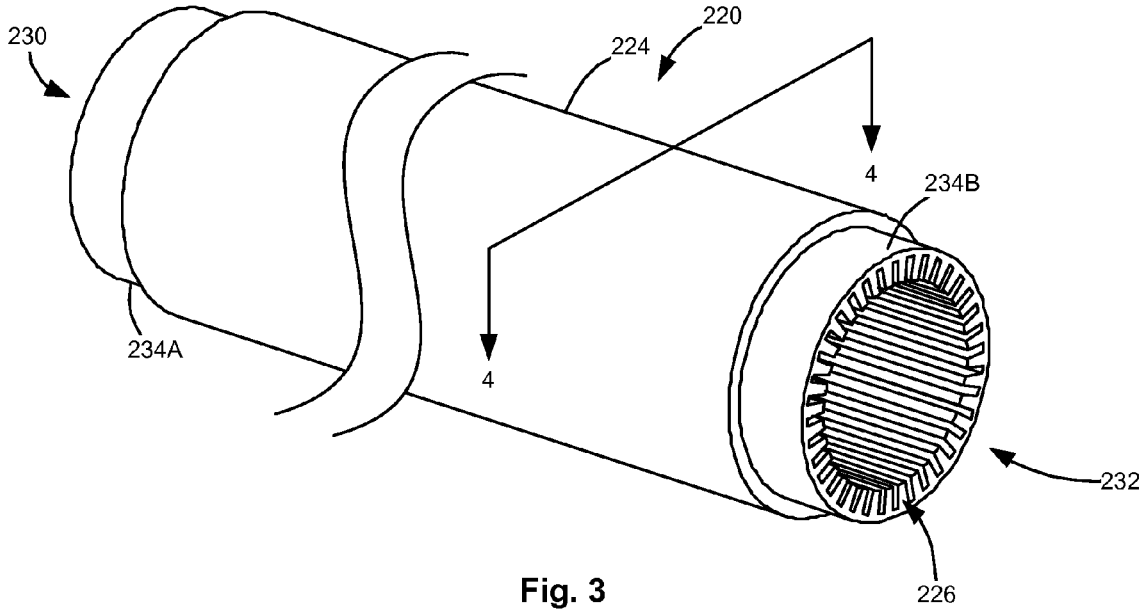
FIG. 3 is a perspective view of a heat exchange roll of the fuser assembly of FIG. 2.
Figure 4:
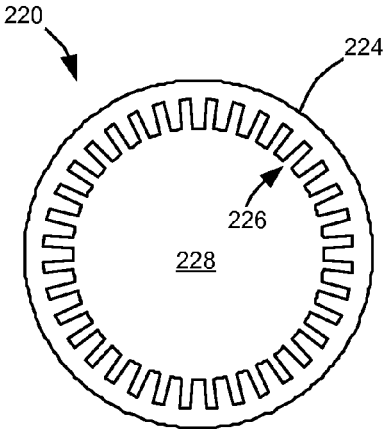
FIG. 4 is a cross sectional view of the heat exchange roll of FIG. 3 according to an example embodiment.

Referring to FIGS. 2-4, the heat transfer system may include a heat exchange roll 220 which contacts backup roll 204 and rotates therewith. Heat exchange roll 220 may be constructed from a metal, such as aluminum or copper, but it is understood that heat exchange roll 220 may be constructed from other metals and/or from other thermally conductive materials. Heat exchange roll 220 may be relatively thin, such as between about 1.0 mm and about 3.0 mm, and particularly about 2.0 mm. Heat exchange roll 220 may substantially extend the entire width of backup roll 204, but in one contemplated embodiment the heat exchange roll 220 may be wider than backup roll 204 so as to provide enough length for mounting on bearings 250A, 250B disposed on each side panel 222A, 222B on both ends of the heat exchange roll 220. Side panels 222A, 222B may form a housing for fuser assembly 120 within which components thereof are disposed. In an example embodiment, heat exchange roll 220 has an outer diameter between about 18 mm and about 20 mm. Heat exchange roll 220 may include a PFA coating along its outer surface.

Referring to FIG. 4, heat exchange roll 220 may include a tube 224 having a plurality of fins 226 extending inwardly from an inner surface of the tube 224 towards a rotational axis of heat exchange roll 220. Tube 224 includes a hollow passageway 228 for cooling air to pass through. In one contemplated embodiment, tube 224 may itself form heat exchange roll 220. Alternatively, tube 224 may be one component of heat exchange roll 220. For example, heat exchange roll 220 may include an outer tube, such as a thermally conductive tube, in which tube 224 is disposed.

In one example embodiment shown in FIGS. 2-4, the plurality of fins 226 may have a trapezoidal cross sectional shape. It is understood, though, that the plurality of fins 226 can have other suitable cross sectional shapes, such as triangular or parabolic. In an example embodiment, the plurality of fins 226 have a height of about 1.5 mm, a thickness of about 1 mm, and are spaced about 0.5 mm from immediately adjacent fins along the inner periphery of tube 224. It may be appreciated that the shape, size, and spacing of the plurality of fins, and any combination thereof may be dictated by particular design requirements. In the example embodiment, fins extend generally radially inwardly, but it is understood that fins 226 may extend inwardly but in a non-radial direction.

Figure 7:
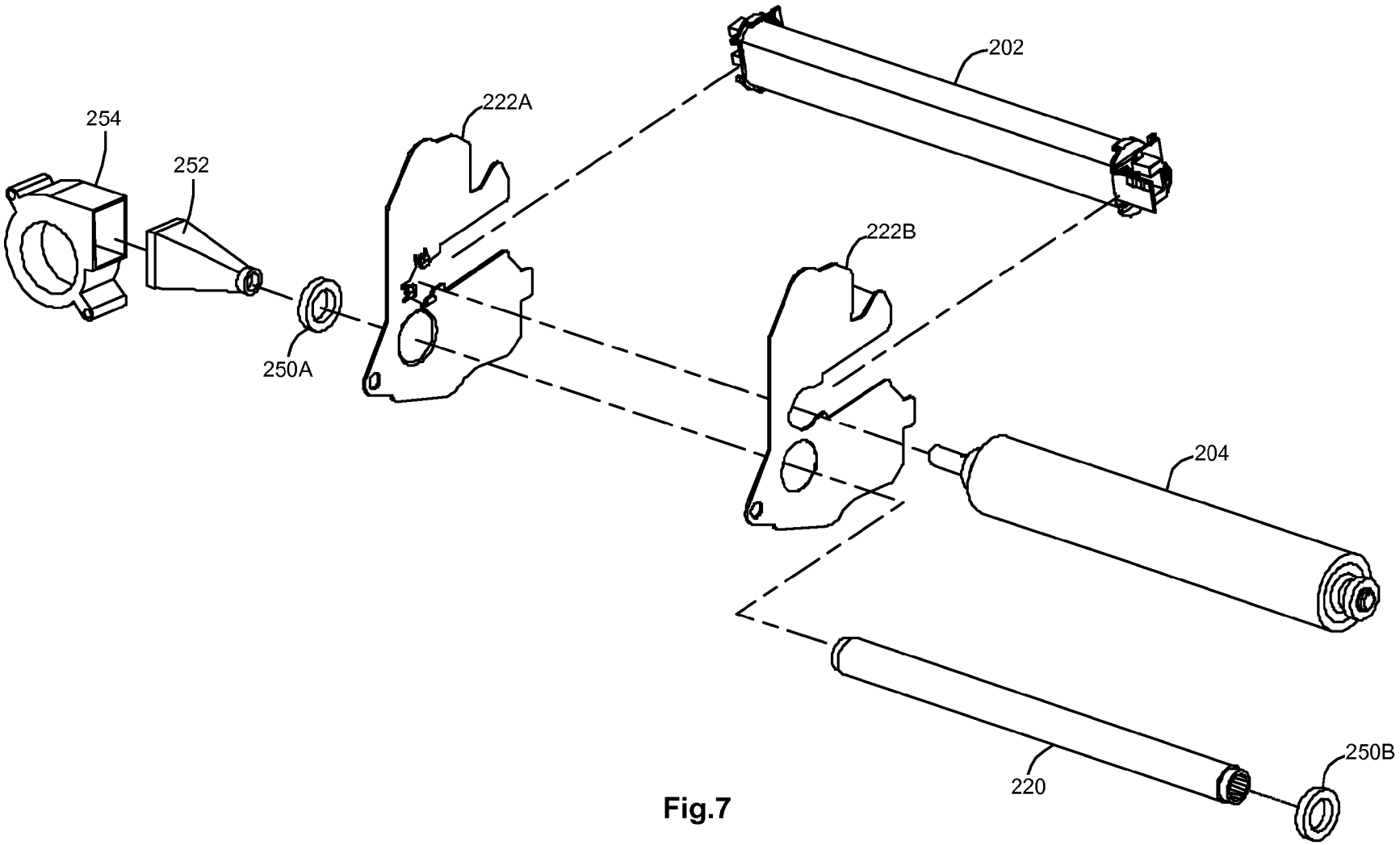
FIG. 7 is an exploded perspective view of the fuser assembly and fan device of FIG. 6.

End portions 234A, 234B of tube 224 may have a smaller outer diameter (as shown in FIG. 3) to allow for mounting on bearings 250A, 250B (shown in FIG. 7). In the example embodiment shown in FIG. 3, end portion 234A forms inlet 230 of tube 224 and end portion 234B forms exit 232 thereof.

Figure 5:
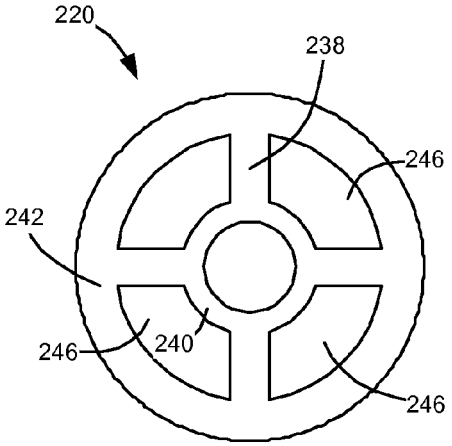
FIG. 5 is a cross sectional view of the heat exchange roll of FIG. 3 according to another example embodiment.

In an alternative embodiment shown in FIG. 5, heat exchange roll 220 may include a plurality of spokes 238 extending radially between a hub 240 and tube 242. A plurality of air passageways 246 are formed in between the spokes 240 along the periphery of the heat exchange roll 220. In another contemplated embodiment (not shown), the heat exchange roll 220 may simply be a hollow tube configured to receive and allow cooling air to pass through.

Heat exchange roll 220 is positioned to have intimate contact with backup roll 204 to remove excess heat therefrom. Further, heat exchange roll 220 may be mounted within fuser assembly 120 so as to substantially freely rotate therein, and contacts backup roll 204 such that heat exchange roll 220 rotates in response to backup roll 204 rotating. This engagement between heat exchange roll 220 and backup roll 204 allows for excess heat from the backup roll 204 to be transferred via conduction to heat exchange roll 220 for sinking the excess heat. In one example embodiment, the heat exchange roll 220 is positioned to exert about 5 psi against the backup roll 204 at a nip N2 formed between heat exchange roll 220 and backup roll 204 (best seen in FIG. 2).

Figure 6:
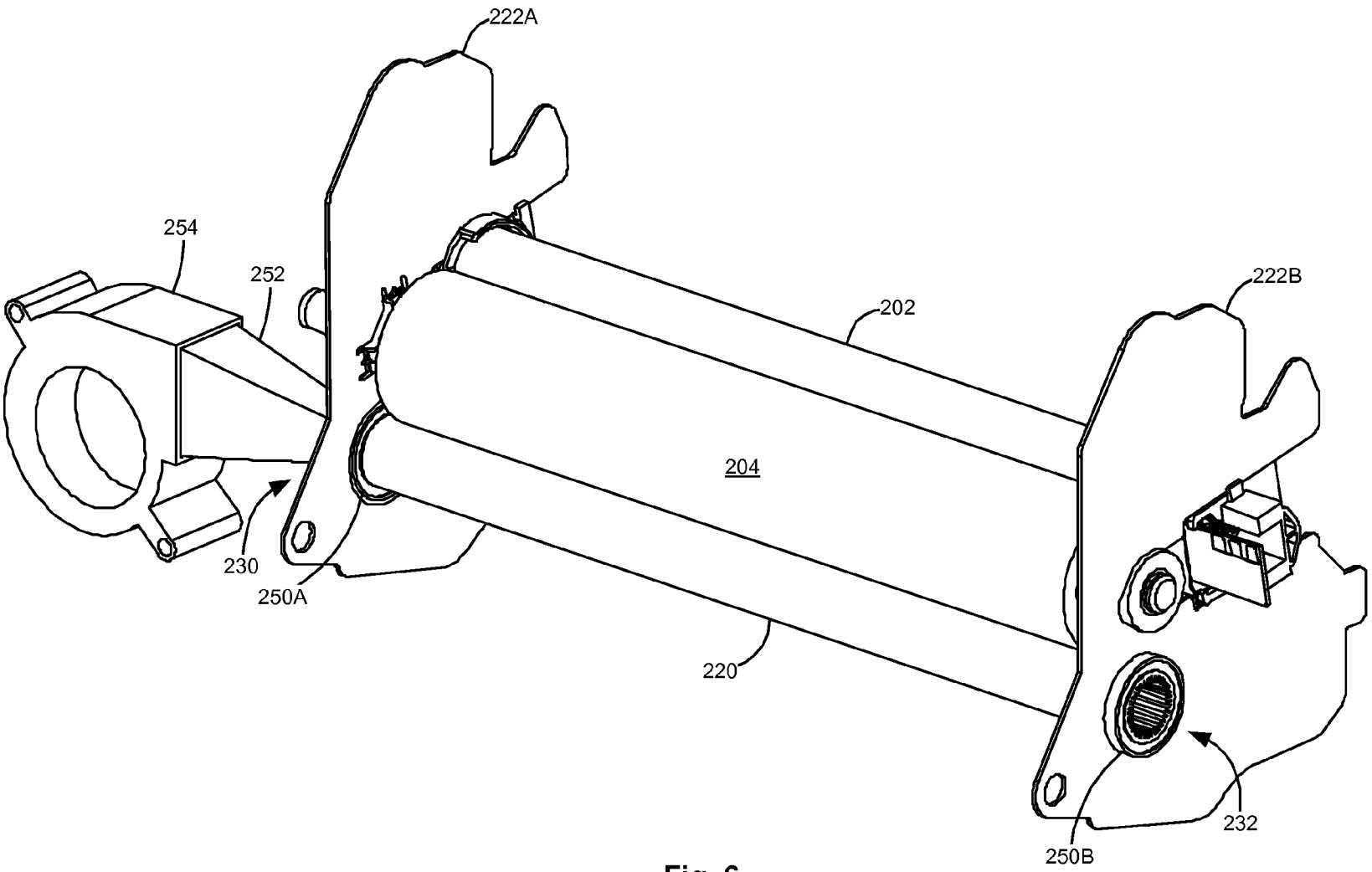
FIG. 6 is a perspective view of the fuser assembly of FIG. 2 in association with a fan device.

Referring to FIGS. 6 and 7, fan 254 is provided to force cooling air across and through the heat exchange roll 220 to remove excess heat energy therefrom. Fan 254 is connected to inlet 230 of the heat exchange roll 220 via duct structure 252. Fan 254 is configured to draw cooling air from outside of the image forming device 100 and to force the cooling air through duct structure 252 and heat exchange roll 220, so that the forced air exits image forming device 100 via an exit duct structure (not shown). In an example embodiment, fan 254 is configured to provide from about 7 to about 10 cubic feet per minute (CFM) of cooling air into and along heat exchange roll 220. It may be appreciated that fan 254 may be configured to supply cooling air to heat exchange roll 220 at varying volumetric flow rates. Duct structure 252 may include a flexible coupling adapted to connect to inlet 230 of heat exchange roll 220. In another contemplated embodiment (not shown), duct structure 252 may be a retractable tube having an end portion that is inserted into inlet 230 of heat exchange roll 220. Specifically, the duct structure may have a retracting mechanism to move the duct structure into the heat exchange roll 220 after installation of the fuser assembly 120 into the image forming device 100 and to move away from the heat exchange roll 220 when the fuser assembly 120 needs to be removed from the image forming device 100. Similarly, the exit duct structure may connect with exit 232 of heat exchange roll 220 to provide an exit passageway for the heated cooling air out of the image forming device 100.

In one example embodiment, fan 254 is disposed adjacent to a portion of backup roll 204 which does not contact narrower media sheets. With heat exchange roll 220 contacting backup roll 204 and rotating therewith, excess heat appearing on the portion of backup roll 204 which does not contact narrower media sheets is removed therefrom, with the excess heat first passing through heat exchange roll 220 via thermal conduction and subsequently removed from the heat exchange roll 220 by forced convection. Cooling air entering inlet 230 absorbs the excess heat from the portion of backup roll 204 which does not contact narrower media sheets and transfers some of the excess heat to the portion of backup roll which contacts the narrower media sheet by heat diffusion. By first removing the excess heat from the portion of the backup roll 204, not only is the portion of backup roll 204 which does not contact the narrower media sheet sufficiently maintained within an acceptable fusing temperature range but also less energy is needed to heat the portion of backup roll which contacts the narrower media sheet.

In another example embodiment, roll 220 is movable between a first position in which roll 220 contacts backup roll 204 and rotates therewith, and a second position in which roll 220 does not contact backup roll 204. Specifically, fuser assembly 120 may include a positioning mechanism for moving roll 220 between the first and second positions. One such positioning mechanism, according to one embodiment, is the positioning mechanism as described in U.S. provisional application No. 61/834,869, filed Jun. 13, 2013, entitled, "Heat Transfer System for A Fuser Assembly," the content of which is hereby incorporated by reference herein in its entirety. Positioning mechanisms, including nip release mechanisms, are well known in the art and for the sake of simplicity, will not be discussed in detail in this disclosure.

As mentioned, controller 140 controls fuser assembly 120. Specifically, controller 140 may control an operating characteristic of fan 254, e.g. volumetric flow rate, based on a sensed or expected temperature of the portion of backup roll 204 which does not contact narrower media sheets. For example, when controller 140 determines that a portion of backup roll 204 is or will be at a temperature above an acceptable fuser temperature range, which may be due to printing on narrower media sheets, controller 140 may control fuser assembly 120 so that fan 254 is operated at a predetermined speed. Controller 140 may make this determination by measuring the temperature of backup roll 204 or determining that narrow media will be used in an upcoming print job from user input or sensing media sheet width within an input tray. Further, when controller 140 determines that a portion of backup roll 204 is or will be at a temperature substantially above an acceptable fuser temperature range, such as by a predetermined amount, controller 140 may control fuser assembly 120 so that fan 254 is operated at a higher speed, thereby increasing the volumetric flow rate of cooling air introduced into the heat exchange roll 220. When the volumetric flow rate of cooling air introduced by fan 254 into the heat exchange roll 220 is increased, more excess heat is removed from the backup roll 204, particularly on the portion of backup roll 204 which does not contact narrower media sheets. Conversely, when controller 140 determines that backup roll 204 is at an acceptable fusing temperature, controller 140 may control fuser assembly 120 so that fan 254 may be turned off or may be operated at a lower speed.

In another example embodiment, when controller 140 determines that a portion of backup roll 204 is or will soon become overheated, i.e., above an acceptable temperature range for a fusing operating, controller 140 may cause the positioning mechanism to move the heat exchange roll 220 to be in contact with backup roll 204. Conversely, when controller 140 determines that backup roll 204 is or will be at an acceptable fusing temperature during a fusing operation, controller 140 may cause the positioning mechanism to move the heat exchange roll 220 away from backup roll 220.

In addition, the example embodiments are described as controller 140 being separate from but communicatively coupled to fuser assembly 120. In an alternative embodiment, controller 140 is mounted on or within fuser assembly 120 and may form part thereof.

The description of the details of the example embodiments have been described in the context of a color electrophotographic imaging devices. However, it will be appreciated that the teachings and concepts provided herein are applicable to monochrome electrophotographic imaging devices.

The foregoing description of several example embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A fuser assembly, comprising:

a heating member including a belt and a heater to heat the belt;

a backup roll disposed proximate to the heating member to engage the belt and form a fuser nip therewith; and a heat exchange roll in contact with the backup roll such that rotation of the backup roll rotates the heat exchange roll, the heat exchange roll having an air passage for moving cooling air from one end portion to an opposite end portion of the heat exchange roll so as to provide cooling to the fuser assembly, wherein the heat exchange roll includes a hollow tube having a plurality of fins extending inwardly from an inner surface of the hollow tube, each fin having a first end connected along the inner surface of the hollow tube and a free end that is unconnected and disposed within a cavity defined by the hollow tube.

2. The fuser assembly of claim 1, wherein the heat exchange roll includes an inlet configured to receive a supply of the cooling air from the one end portion of the heat exchange roll and direct the supply of the cooling air towards the opposite end portion of the heat exchange roll.

3. The fuser assembly of claim 2, wherein the inlet is positioned proximate the one end portion of the heat exchange roll in contact with a higher temperature section of the backup roll relative to a temperature of a section of the backup roll proximate the opposite end portion of the heat exchange roll.

4. The fuser assembly of claim 2, further comprising an exhaust duct for providing an exit for the cooling air, the exhaust duct connected to the opposite end portion of the heat exchange roll.

5. The fuser assembly of claim 1, wherein the heat exchange roll comprises a hollow metal roll.

6. The fuser assembly of claim 1, wherein the heat exchange roll has an axial length longer than an axial length of the backup roll.

7. The fuser assembly of claim 1, wherein the heat exchange roll has a thickness between about 1 mm and about 3 mm.

8. The fuser assembly of claim 1, wherein the heat exchange roll has an external surface coated with polytetrafluoroethylene.

9. The fuser assembly of claim 1, further comprising:

a housing having opposed first and second sides for supporting the backup roll and the heating member; and a positioning mechanism coupling the heat exchange roll to the housing, the positioning mechanism moving the heat exchange roll between a first position in which the heat exchange roll is engaged with and contacts the backup roll and a second position in which the heat exchange roll is disengaged and spaced apart therefrom.

10. An apparatus, comprising:

a housing having opposed first and second side panels;

a heating member, the heating member supported on opposite ends on the opposed first and second side panels of the housing;

a backup roll rotatably mounted between the opposed first and second side panels of the housing, the backup roll disposed proximate to the heating member to form a fuser nip therewith for fusing toner to sheets of media; and a heat exchange roll rotationally mounted between the opposed first and second side panels of the housing and in contact with the backup roll such that rotation of the backup roll rotates the heat exchange roll, the heat exchange roll having an orifice for cooling air to pass through from one end portion on the first side panel of the housing to an opposite end portion of the heat exchange roll on the second side panel of the housing, wherein the contact of the heat exchange roll and the backup roll provides cooling to at least a portion of the backup roll, wherein the heat exchange roll comprises a hollow tube having a plurality of fins, each fin having a first end connected along an inner surface of the hollow tube and a free end that is unconnected and disposed within a cavity defined by the hollow tube.

11. The apparatus of claim 10, wherein the heat exchange roll includes an inlet configured to receive a supply of the cooling air from the one end portion towards the opposite end portion of the heat exchange roll.

12. The apparatus of claim 11, wherein the inlet is positioned proximate the one end portion of the heat exchange roll in contact with a higher temperature section of the backup roll relative to a temperature of a section of the backup roll proximate the opposite end portion.

13. The apparatus of claim 11, further comprising an exhaust duct for providing an exit for the cooling air, the exhaust duct connected to the opposite end portion of the heat exchange roll.

14. The apparatus of claim 10, wherein each of the plurality of fins has a substantially trapezoidal, triangular or parabolic cross-sectional shape.

15. The apparatus of claim 10, wherein the heat exchange roll comprises a hollow metal roll.

16. The apparatus of claim 10, wherein the heat exchange roll has an axial length longer than the backup roll.

17. The apparatus of claim 10, further comprising a positioning mechanism coupling the heat exchange roll to the housing, the positioning mechanism moving the heat exchange roll between a first position in which the heat exchange roll is engaged with and contacts the backup roll and a second position in which the heat exchange roll is disengaged and spaced apart therefrom.

18. A fuser assembly, comprising:

a heating member including a belt and a heater to heat the belt;

a backup roll disposed proximate to the heating member to engage the belt and form a fuser nip therewith;

a heat exchange roll in contact with the backup roll such that rotation of the backup roll rotates the heat exchange roll, the heat exchange roll having an air passage for moving cooling air from one end portion to an opposite end portion of the heat exchange roll so as to provide cooling to the fuser assembly; and a fan in communication with the one end portion of the heat exchange roll for supplying the cooling air from the one end portion of the heat exchange roll to the opposite end portion thereof, the one end portion being at a temperature that is greater than a temperature of the opposite end portion during a fusing operation, wherein the heat exchange roll includes a tube having a plurality of spokes extending substantially radially towards an inner hub, the tube having an outer surface in contact with the backup roll, and wherein the heat exchange roll further includes an inlet configured to receive the cooling air from the fan at the one end portion of the heat exchange roll and direct the cooling air towards the opposite end portion of the heat exchange roll, the inlet being positioned proximate the one end portion of the heat exchange roll in contact with a higher temperature section of the backup roll relative to a temperature of the section of the backup roll proximate the opposite end portion of the heat exchange roll.

19. A fuser assembly, comprising:

a heating member including a belt and a heater to heat the belt;

a backup roll disposed proximate to the heating member to engage the belt and form a fuser nip therewith; and a heat exchange roll in contact with the backup roll such that rotation of the backup roll rotates the heat exchange roll, the heat exchange roll having an air passage for moving cooling air from one end portion to an opposite end portion of the heat exchange roll so as to provide cooling to the fuser assembly, wherein the heat exchange roll has an axial length longer than an axial length of the backup roll, and wherein the heat exchange roll includes a hollow tube having a plurality of fins each having a free end disposed inwardly of an inner surface of the hollow tube.

20. A fuser assembly, comprising:

a heating member including a belt and a heater to heat the belt;

a backup roll disposed proximate to the heating member to engage the belt and form a fuser nip therewith; and a heat exchange roll in contact with the backup roll such that rotation of the backup roll rotates the heat exchange roll, the heat exchange roll having an air passage for moving cooling air from one end portion to an opposite end portion of the heat exchange roll so as to provide cooling to the fuser assembly, wherein the heat exchange roll has a thickness between about 1 mm and about 3 mm, and wherein the heat exchange roll includes a hollow tube having a plurality of fins each having a free end extending inwardly from an inner surface of the hollow tube.

21. A fuser assembly, comprising:

a heating member including a belt and a heater to heat the belt;

a backup roll disposed proximate to the heating member to engage the belt and form a fuser nip therewith; and a heat exchange roll in contact with the backup roll such that rotation of the backup roll rotates the heat exchange roll, the heat exchange roll having an air passage for moving cooling air from one end portion to an opposite end portion of the heat exchange roll so as to provide cooling to the fuser assembly, wherein the heat exchange roll has an external surface coated with polytetrafluoroethylene, and wherein the heat exchange roll includes a hollow tube having a plurality of fins each having a free, unconnected end disposed within a cavity defined by the hollow tube.

22. A fuser assembly, comprising:

a heating member including a belt and a heater to heat the belt;

a backup roll disposed proximate to the heating member to engage the belt and form a fuser nip therewith;

a heat exchange roll in contact with the backup roll such that rotation of the backup roll rotates the heat exchange roll, the heat exchange roll having an air passage for moving cooling air from one end portion to an opposite end portion of the heat exchange roll so as to provide cooling to the fuser assembly;

a housing having opposed first and second sides for supporting the backup roll and the heating member;

a positioning mechanism coupling the heat exchange roll to the housing, the positioning mechanism moving the heat exchange roll between a first position in which the heat exchange roll is engaged with and contacts the backup roll and a second position in which the heat exchange roll is disengaged and spaced apart therefrom; and a fan in communication with the one end portion of the heat exchange roll for supplying the cooling air from the one end portion of the heat exchange roll to the opposite end portion thereof, the one end portion being at a temperature that is greater than a temperature of the opposite end portion during a fusing operation.

* * * * *